US010598431B2

(12) United States Patent
Pek et al.

(10) Patent No.: US 10,598,431 B2
(45) Date of Patent: Mar. 24, 2020

(54) METHOD AND SYSTEM FOR COOLING AND SEPARATING A HYDROCARBON STREAM

(71) Applicant: SHELL OIL COMPANY, Houston, TX (US)

(72) Inventors: Johan Jan Barend Pek, Rijswijk (NL); Karel Antonius Kusters, Rijswijk (NL); Meta Jannetta Van Veghel, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 102 days.

(21) Appl. No.: 15/742,624

(22) PCT Filed: Jul. 8, 2016

(86) PCT No.: PCT/EP2016/066233
§ 371 (c)(1),
(2) Date: Jan. 8, 2018

(87) PCT Pub. No.: WO2017/009210
PCT Pub. Date: Jan. 19, 2017

(65) Prior Publication Data

US 2018/0202713 A1 Jul. 19, 2018

(30) Foreign Application Priority Data

Jul. 10, 2015 (EP) ..... 15176318

(51) Int. Cl.
*F25J 3/02* (2006.01)
*F25J 1/02* (2006.01)
(Continued)

(52) U.S. Cl.
CPC ..... *F25J 3/0209* (2013.01); *F25J 1/0022* (2013.01); *F25J 1/0035* (2013.01); *F25J 1/0042* (2013.01);
(Continued)

(58) Field of Classification Search
CPC ..... F25J 1/0237; F25J 1/0035; F25J 1/0032; F25J 2200/38; F25J 3/0233; F25J 3/0238; F25J 3/0247
See application file for complete search history.

(56) References Cited

U.S. PATENT DOCUMENTS 4,889,545 A 12/1989 Campbell et al.
5,453,559 A 9/1995 Phillips et al.
(Continued)

FOREIGN PATENT DOCUMENTS

EP 1469266 A1 10/2004
WO 2009010558 A2 1/2009
(Continued)

OTHER PUBLICATIONS

WO-2016134815-A1 Translation (Year: 2016).*
(Continued)

*Primary Examiner* — Brian M King

(57) ABSTRACT

The present invention relates to a method of cooling and separating a hydrocarbon stream: (a) passing an hydrocarbon feed stream (7) through a first cooling and separation stage to provide a methane enriched vapour overhead stream (110) and a methane depleted liquid stream (10); (b) passing the methane depleted liquid stream (10) to a fractionation column (200) to obtain a bottom condensate stream (210), a top stream enriched in C1-C2 (220) and a midstream enriched in C3-C4 (230), (c) cooling the upper part of the fractionation column (201) by a condenser (206), (d) obtaining a split stream (112) from the methane enriched vapour
(Continued)

Figure 1:
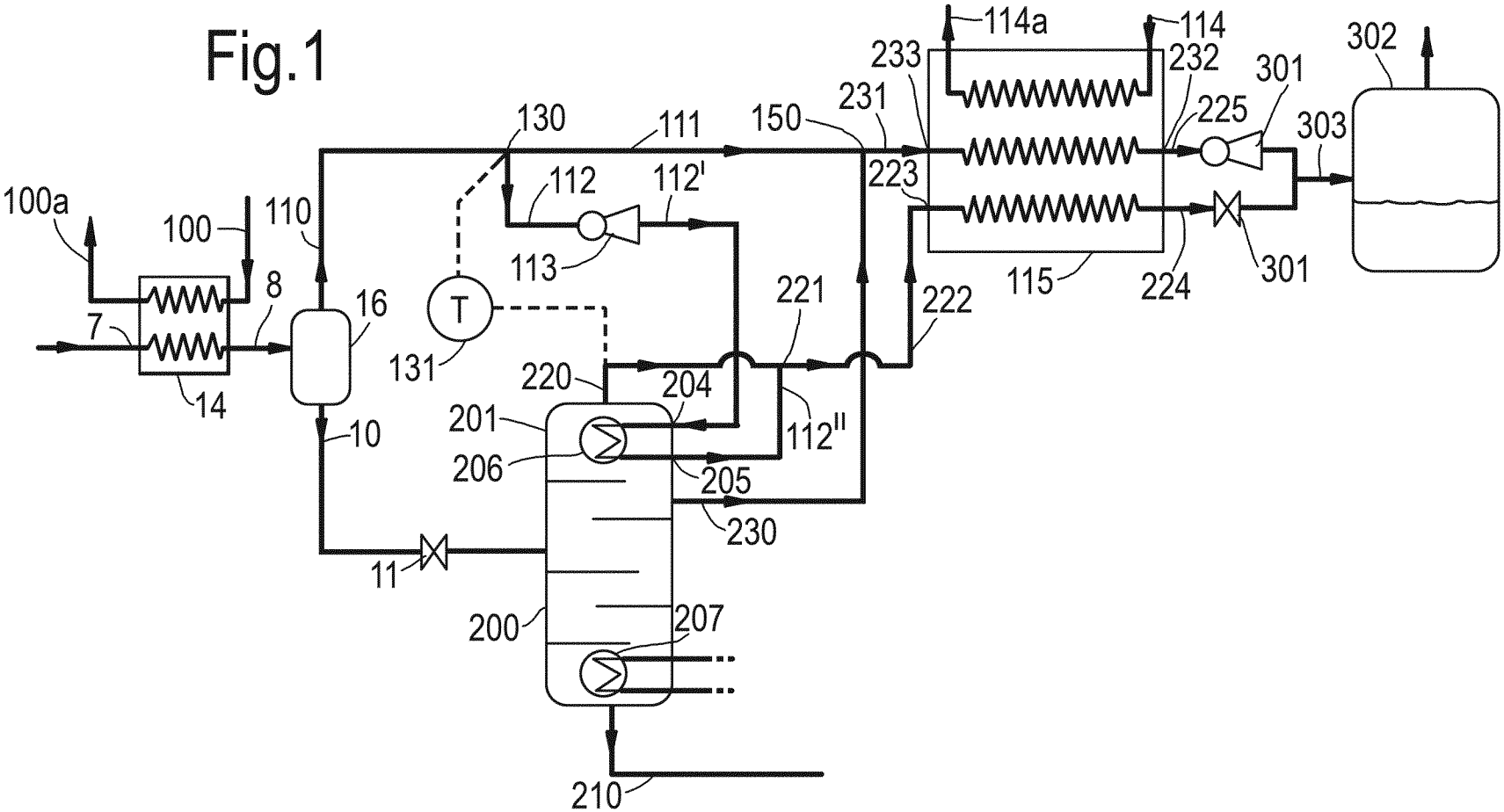

overhead stream (110) and obtaining a cooled split stream (112') by expansion-cooling the split stream (112), (e) providing cooling duty to the top of the fractionation column (201) using the cooled split stream (112').

13 Claims, 3 Drawing Sheets

(51) Int. Cl.
*F25J 1/00* (2006.01)
*F25J 3/06* (2006.01)

(52) U.S. Cl.
CPC ..... *F25J 1/0045* (2013.01); *F25J 1/0052* (2013.01); *F25J 1/0055* (2013.01); *F25J 1/0205* (2013.01); *F25J 1/0214* (2013.01); *F25J 1/0216* (2013.01); *F25J 1/0231* (2013.01); *F25J 1/0237* (2013.01); *F25J 1/0239* (2013.01); *F25J 1/0255* (2013.01); *F25J 1/0262* (2013.01); *F25J 3/0233* (2013.01); *F25J 3/0242* (2013.01); *F25J 3/0247* (2013.01); *F25J 3/061* (2013.01); *F25J 3/0635* (2013.01); *F25J 2200/02* (2013.01); *F25J 2200/04* (2013.01); *F25J 2200/38* (2013.01); *F25J 2200/50* (2013.01); *F25J 2200/72* (2013.01); *F25J 2200/74* (2013.01); *F25J 2200/94* (2013.01); *F25J 2205/04* (2013.01); *F25J 2210/06* (2013.01); *F25J 2210/60* (2013.01); *F25J 2215/02* (2013.01); *F25J 2215/04* (2013.01); *F25J 2220/62* (2013.01); *F25J 2245/02* (2013.01); *F25J 2260/20* (2013.01); *F25J 2270/02* (2013.01); *F25J 2270/04* (2013.01); *F25J 2280/02* (2013.01)

(56) References Cited

U.S. PATENT DOCUMENTS

| | | | | |
|---|---|---|---|---|
| 2004/0079107 | A1* | 4/2004 | Wilkinson | F25J 1/0239 62/611 |
| 2008/0016910 | A1 | 1/2008 | Brostow et al. | |
| 2009/0107174 | A1 | 4/2009 | Ambari et al. | |
| 2011/0167868 | A1* | 7/2011 | Pierce | F25J 3/0209 62/620 |

FOREIGN PATENT DOCUMENTS

| | | | | |
|---|---|---|---|---|
| WO | 2009101127 | A2 | 8/2009 | |
| WO | WO-2016134815 | A1 * | 9/2016 | F25J 3/0209 |

OTHER PUBLICATIONS

International Search Report and Written Opinion received for PCT Patent Application No. PCT/EP2016/066233, dated Oct. 12, 2016, 9 pages.

* cited by examiner

METHOD AND SYSTEM FOR COOLING AND SEPARATING A HYDROCARBON STREAM

CROSS REFERENCE TO RELATED APPLICATIONS

This is a national stage application of International application No. PCT/EP2016/066233, filed 8 Jul. 2016, which claims benefit of priority of European application No. 15176318.2, filed 10 Jul. 2015.

The present invention relates to a method and system for cooling and separating a hydrocarbon stream.

A common hydrocarbon stream to be cooled, optionally to full liquefaction, is natural gas.

Natural gas is a useful fuel source, as well as being a source of various hydrocarbon compounds. It is often desirable to liquefy natural gas in a liquefied natural gas (LNG) plant at or near the source of a natural gas stream for a number of reasons. For example, natural gas can be stored and transported over long distances more readily as a liquid than in gaseous form, because it occupies a smaller volume and does not need to be stored at high pressure.

Usually, natural gas, comprising predominantly methane, enters an LNG plant at elevated pressures and is pre-treated to produce a purified feed stream suitable for liquefaction at cryogenic temperatures. The purified gas is processed through a plurality of cooling stages using heat exchangers to progressively reduce its temperature until liquefaction is achieved. The liquid natural gas is then further cooled and expanded to final atmospheric pressure suitable for storage and transportation.

In addition to methane, natural gas usually includes some heavier hydrocarbons and non-hydrocarbons, including but not limited to carbon dioxide, mercury, sulphur, hydrogen sulphide and other sulphur compounds, nitrogen, helium, water and other non-hydrocarbon acid gases, ethane, propane, butanes, $C_5$+ hydrocarbons and aromatic hydrocarbons. These and any other common or known heavier hydrocarbons and non-hydrocarbons either prevent or hinder the usual known methods of liquefying the methane, especially the most efficient methods of liquefying methane.

Hydrocarbons heavier than methane and usually ethane are typically condensed and recovered as natural gas liquids (NGL) from a natural gas stream. Hydrocarbons heavier than methane and ethane are typically removed from the initial feed stream by partly condensing (pre-cooling) the initial feed stream, separating the condensed mixed hydrocarbon fraction from the lighter vapour fraction in a column or vessel and continuously feeding the liquid stream to a fractionation unit where extraction of NGL takes place. Typically this fractionation unit consists of a multiple column recovery system containing various vapour liquid separator columns, either (reboiled) absorber(s) or distillation column(s) that might require cooling and/or heating duty via condensers and reboilers.

The columns are usually referred to as demethanizer, de-ethanizer, depropanizer and debutanizer.

The NGLs are usually fractionated in an NGL recovery system to yield valuable hydrocarbon products, either as products steams per se, or for use in liquefaction, for example as a component of a refrigerant or for reintroduction downstream with the main methane-based liquefied product stream.

However, NGL recovery conventionally involves cooling, condensation and fractionation steps that require significant amounts of refrigeration and other power consumption.

Different schemes are known from the prior art for this.

US20080016910 describes a process for the liquefaction of natural gas and the recovery of components heavier than methane wherein natural gas is cooled and separated in a first distillation column into an overhead vapor enriched in methane and a bottoms stream enriched in components heavier than methane, wherein the first distillation column utilizes a liquefied methane-containing reflux stream. This reflux stream may be provided by a condensed portion of the overhead vapor or a portion of totally condensed overhead vapor that is subsequently warmed. The bottoms stream may be separated in one or more additional distillation columns to provide one or more product streams, any of which are partially or totally withdrawn as recovered hydrocarbons. A stream of unrecovered liquid hydrocarbons may be combined with either the condensed portion of the overhead vapor or a portion of totally condensed overhead vapor that is subsequently warmed.

EP1469266 describes a process for the recovery of components heavier than methane from natural gas, including withdrawing from an absorber column a bottom stream enriched in components heavier than methane, and separating this into a stream containing methane and ethane, and one or more streams enriched in components heavier than ethane.

An absorber column is used to separate the feed into a bottoms liquid enriched in heavier hydrocarbons and a first overhead vapor enriched in methane. A portion of the bottoms liquid, generally described as natural gas liquid (NGL), flows to a NGL fractionation system. Here, the NGL is separated using well-known distillation processes including de-ethanizer, depropanizer, and/or debutanizer columns to provide two or more hydrocarbon fractions.

Both US20080016910 and EP1469266 require a distillation column for each separate product stream, including associated auxiliary equipment like piping, reboilers, condensers, accumulators, pumps and are thus expensive and occupy a relatively large plot space.

WO2009010558 describes to the use of two or more gas/liquid separators in series used in NGL recovery. In this process a condensed mixed hydrocarbon feed stream is separated into at least a first part-feed stream and a second part-feed stream. The first part-feed stream is passed into a first gas/liquid separator, to provide at least a first fractionated stream in the form of a first gaseous overhead stream. A first bottom liquid stream provided by the first gas/liquid separator is passed into a second gas/liquid separator to provide at least a second fractionated stream in the form of a second gaseous overhead stream, which is cooled by heat exchange against the second part-feed stream. Thus, cold energy from another source, such as (pre-) cooling of a hydrocarbon stream such as natural gas by a separate refrigerant, refrigeration system or circuit, need not be diverted to be involved in recovery and fractionation of the mixed hydrocarbon stream, such as in NGL recovery, thereby increasing the efficiency of other processes or sections of a liquefaction plant such as an LNG plant. However, this process also requires a series of gas/liquid separators including all associated hardware auxiliary equipment.

WO2009101127 describes a method and apparatus for cooling a hydrocarbon stream such as natural gas. An initial hydrocarbon stream is passed through a first separator to provide an initial overhead stream and a mixed hydrocarbon feed stream. The initial overhead stream is cooled to provide a cooled hydrocarbon stream such as LNG, and at least a C1 overhead stream and one or more C2, C3 and C4 overhead streams are separated from the mixed hydrocarbon feed stream. At least a fraction of at least one of the group comprising: the C2 overhead stream, the C3 overhead stream and the C4 overhead stream; is cooled with the C1 overhead stream to provide a cooled stream, which is further cooled against at least a fraction of the cooled, preferably liquefied, hydrocarbon stream to provide an at least partly liquefied cooled stream.

All prior art document cited above require a NGL recovery scheme comprising a plurality of fractionation columns in series in order to obtain a corresponding number of separate streams.

It is desirable to recover NGLs from a natural gas stream with a more cost effective scheme, which requires less auxiliary equipment, plot space and capital investments.

The present invention provides a method of cooling and separating a hydrocarbon stream, comprising at least the steps of:

(a) passing an hydrocarbon feed stream (7) through a first cooling and separation stage to provide a methane enriched vapour overhead stream (110) and a methane depleted liquid stream (10);

(b) passing the methane depleted liquid stream (10) to a fractionation column (200) to separate the methane depleted liquid stream (10) in a bottom condensate stream (210), a top stream enriched in C1-C2 (220) and a midstream enriched in C3-C4 (230), (c) cooling the upper part of the fractionation column (201) by a condenser (206), (d) splitting the methane enriched vapour overhead stream (110) in a main overhead stream (111) and a split stream (112) and obtaining a cooled split stream (112') by expansion-cooling the split stream (112), (e) feeding a condenser feed stream (204) to the condenser (206), the condenser feed stream (204) comprising the cooled split stream (112'), to provide cooling duty to the top of the fractionation column (201). The present invention also provides a system for cooling and separating a hydrocarbon stream comprising a

- first cooling and separation stage for receiving a hydrocarbon feed stream (7) and generate a methane enriched vapour overhead stream (110) and a methane depleted liquid stream (10);
- a fractionation column comprising an inlet arranged to receive the methane depleted liquid stream (10), a bottom outlet for discharging a bottom condensate stream (210), a top outlet for discharging a top stream enriched in C1-C2, and a mid-outlet for discharging a midstream enriched in C3-C4 (230),
- an expansion-cooling device arranged to receive a split stream (112) from the methane enriched vapour overhead stream (110) and generate a cooled split stream (112') by expansion-cooling the split stream (112),
- a condenser (206) being positioned in the upper part of the fractionation column (201) to provide cooling duty to the fractionation column (201), the condenser (206) comprising an inlet for receiving a condenser feed stream (204), wherein the condenser feed stream (204) comprises the cooled split stream (112').

The hydrocarbon stream comprises methane, ethane, propane, butane and pentane.

The split stream may be split off from the methane enriched vapour overhead stream (110) using any suitable hardware piece, such as a T-piece, splitting the methane enriched vapour overhead stream (110) in the split stream (112) and a main overhead stream (111). The flow rate of the split stream is preferably controllable.

The condenser may be an internal condenser (206), positioned in the upper part of the fractionation column (201), preferably above a highest tray in the fractionation column (201).

The invention further relates to a liquefied natural gas plant of facility comprising such a system. A liquefied natural gas plant is a plant producing liquefied natural gas. The facility may be an on-shore or an off-shore facility, including a floating facility.

The present invention also provides a liquefied natural gas plant or facility including a system as herein defined.

Figure 2:
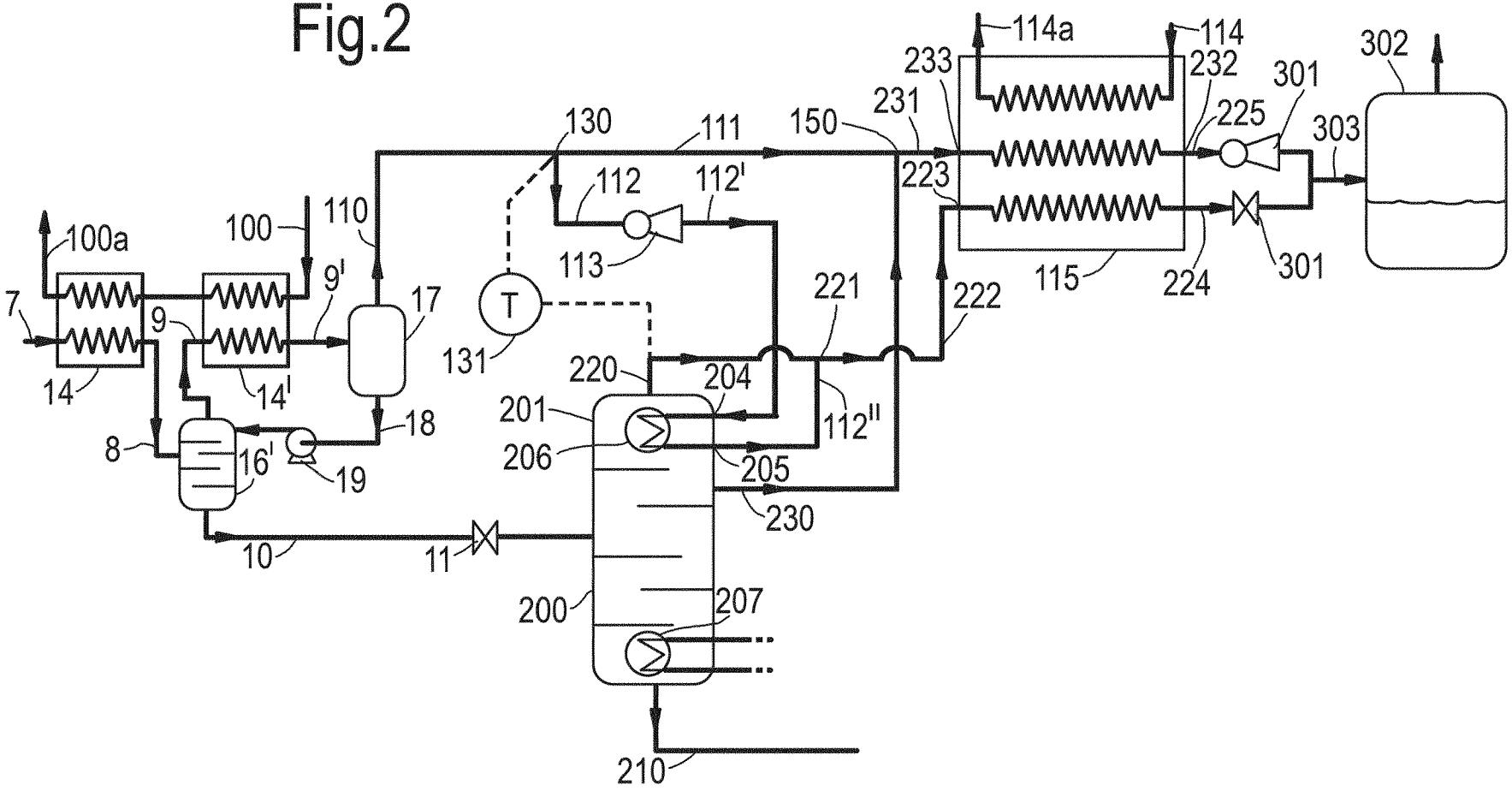

Embodiments and examples of the present invention will now be described by way of example only and with reference to the accompanying non-limiting drawings in which:

FIG. 1 schematically shows a first embodiment;

FIG. 2 schematically shows a second embodiment; and

Figure 3:
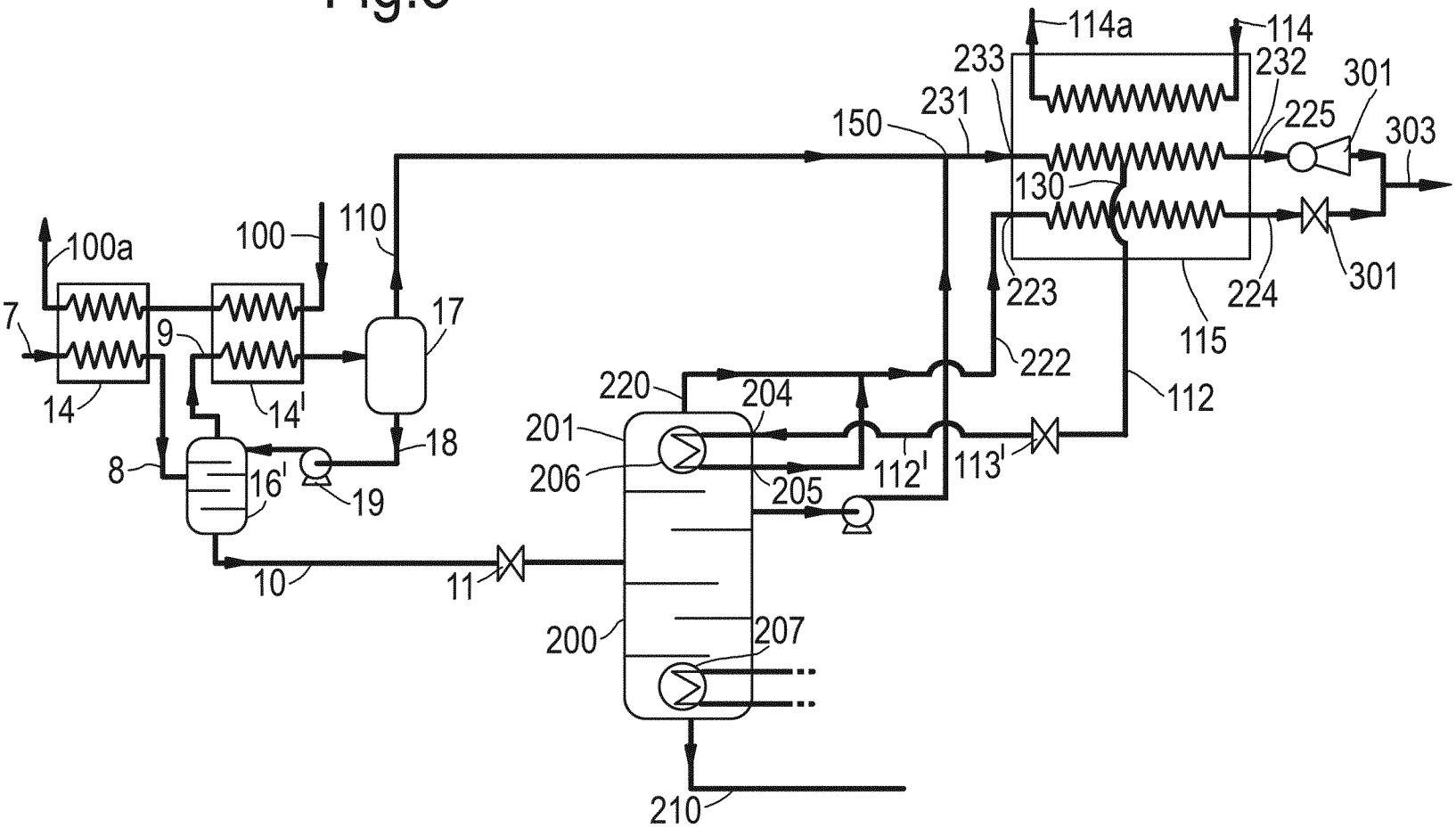

FIG. 3 schematically shows a third embodiment.

For the purpose of this description, a single reference number will be assigned to a line as well as a stream carried in that line.

It is suggested to perform NGL extraction using a fractionation column providing a bottom condensate stream, a top stream enriched in C1-C2 and a midstream enriched in C3-C4. This saves plot space, weight and equipment count/CAPEX. The condensate stream is enriched in C5+.

Instead of a series of fractionation columns, each having associated auxiliary equipment including re-boilers, condensers, accumulators, pumps and associated piping, it is proposed to use a single fractionation column, preferably having an internal condenser and internal reboiler, thereby obtaining a significant reduction on hardware elements. This allows for a more compact design with a reduced equipment count and reduced piping and thus with a reduced weight. A reduced weight can result in reduced required foundation and structural steel when the fractionation section is integrated inside a module. It also makes transportation of moveable modules easier and is advantageous for floating applications.

By combining multiple fractionation columns into a single fractionation column having three outlet streams as described above, the temperature of the top of the single fractionation column is typically below ambient temperature and therefore using ambient air or cooling water to provide sufficient condenser duty to the column is not practicable, if not impossible.

By using a split stream of the methane enriched vapour overhead stream 110 to provide cooling duty instead of an ambient (water/air) stream or a refrigerant stream, the equipment count (less auxiliary equipment, less piping) can be further reduced.

A method of and a system for cooling and separating a hydrocarbon stream is provided as for instance shown in FIG. 1.

A hydrocarbon feed stream is passed through a first cooling and separation stage, thereby providing a methane enriched vapour overhead stream 110 and a methane depleted liquid stream 10. This corresponds with (a) as mentioned above.

According to an embodiment (a), being the first cooling and separation stage as defined above comprises (a1) passing the hydrocarbon feed stream 7 through a pre-cooler 14 obtaining a pre-cooled, partially condensed hydrocarbon feed stream 8, (a2) passing the pre-cooled, partially condensed hydrocarbon feed stream 8 to a first separator 16 to separate the methane depleted liquid stream 10 from the pre-cooled partially condensed hydrocarbon feed stream 8.

This is schematically shown in FIG. 1, showing a first cooling and separation stage comprising the pre-cooler 14 and the first separator 16. The first separator 16 may be a knock-out drum. The pre-cooler 14 is arranged to receive a hydrocarbon feed stream 7, cool the hydrocarbon feed stream 7 and pass it to the first separator 16. The pre-cooler 14 is arranged to receive a refrigerant stream 100 and discharge a warmed refrigerant stream 100*a*. The refrigerant cycle, typically comprising a compressor, condenser and expansion valve, is not shown.

The pre-cooler 14 is schematically shown as a single heat exchanger 14, but may comprise a plurality of parallel and/or serial heat exchangers. The pre-cooler 14 may cool the hydrocarbon feed stream using a first refrigerant, which may be a single component refrigerant, such as propane, or a mixed refrigerant, for instance comprising a selection of the following components: propane, ethane/ethylene and butane.

The separator 16 has an overhead outlet from which, in use, a methane enriched vapour overhead stream 110 is obtained and a bottom outlet from which in use a methane depleted liquid stream 10 is obtained.

According to an embodiment, shown in FIG. 2, (a) (being the first cooling and separation stage), further comprises (a3) obtaining a pre-cooled vapour hydrocarbon stream 9 as top stream from the first separator 16 and passing the pre-cooled vapour hydrocarbon stream 9 to a further pre-cooler 14' obtaining a further pre-cooled hydrocarbon feed stream 9', (a4) passing the further pre-cooled hydrocarbon feed stream 9' to a second separator 17 to separate the methane enriched vapour overhead stream 110 from the further pre-cooled hydrocarbon feed stream 9'.

Both the pre-cooler 14 and the further pre-cooler 14' may be cooled by the same refrigerant. Again, the pre-cooler 14 and further pre-cooler are schematically shown as single heat exchangers, but may each comprise a plurality of parallel and/or serial heat exchangers.

According to this embodiment, the first separator is a scrub column 16', comprising a plurality of trays and may be provided with an (internal) reboiler (not shown).

The second separator 17, which may be a knock-out vessel, may further produce a bottom stream 18 which is passed to the first separator 16', e.g. using a pump 19, and is provided as reflux to the first separator 16'. The bottom stream 18 may be introduced in the first separator 16' at a higher level than the pre-cooled, partially condensed hydrocarbon feed stream 8 is introduced.

Both in the embodiment depicted in FIGS. 1 and 2, the methane depleted liquid stream 10 is passed to a fractionation column 200 to separate the methane depleted liquid stream 10 in a bottom condensate stream 210, a top stream 220 enriched in C1-C2 and a midstream 230 enriched in C3-C4.

The top stream 220 is enriched in C1-C2, i.e. enriched in methane, ethane, the mid-stream 230 is enriched in C3-C4, i.e. enriched in propane and butane, and the bottom condensate stream 210 is enriched in components heavier than butane, such as pentane.

The term enriched is used to indicate that the mol % of the indicated component(s) has/have been increased with respect to the mol % of the same component(s) from which the enriched stream was obtained, in this case the methane depleted liquid stream 10.

The flow rate of the methane depleted liquid stream 10 can be controlled by a valve 11.

Fractionation column 201 comprises any suitable mass transfer equipment such as packing or a plurality of internal trays, positioned at different levels in the fractionation column 201. The fractionation column 201 may be provided with a reboiler 207 positioned below the rectifying section, e.g. below the lowest tray. The re-boiler may be an external reboiler, but preferably is an internal reboiler 207 to have a more compact design.

The fractionation column 201 is schematically depicted comprising an internal condenser 206 and internal reboiler 207. It will be understood that the fractionation column 201 may alternatively comprise an external condenser and/or external reboiler.

Furthermore, for all embodiments described, the fractionation column 201 may comprise additional hardware for further optimization of the fraction column 201, i.e. the fractionation column 201 may be a divided wall column or equipped with a side-stripper on stream 230, etc.

The upper part of the fractionation column 201 comprises an internal condenser 206 to provide sufficient cooling duty to the fractionation column 201. The internal condenser 206 is positioned above the rectifying section, e.g. above the upper tray.

The methane enriched vapour overhead stream 110 is split in a split stream 112 and a main overhead stream 111. In the figures this is done at junction 130, which may be a splitting device, such as a T-piece with two independent outlet valves.

The split stream 112 is typically smaller than the main overhead stream 111. The flow rate of the split stream 112 is preferably controlled. This may be done in any suitable manner, including a controllable splitting device.

The split stream 112 may for instance have flow of less than 25 mass % of the main overhead stream 111, or less than 15 mass % of the main overhead stream 111, or less than 10 mass % of the main overhead stream 111, for instance 9 mass % of the main overhead stream 111. The split stream 112 is passed through an expander 113 or a valve to obtain a cooled split stream 112' by expansion-cooling the split stream 112.

The term expansion-cooling is used in this text to refer to an isotropic process, wherein the split stream 112 passes through an (turbo-) expander 113, work is extracted from the split stream 112, and the pressure and temperature of the split stream 112 are lowered, and to an isenthalpic process, wherein the split stream 112 passes through a (throttling) valve (e.g. Joule-Thompson valve), and the pressure and temperature of the split stream 112 are lowered.

Thus, the split stream 112 may be passed over a (throttling) valve or an (turbo) expander 113 to reduce the temperature of the split stream to a temperature sufficiently low to provide cooling duty to the top of the fractionation column.

A valve is less efficient in terms of recovering cold, but is typically more reliable as it doesn't comprise moving/rotating parts.

According to an embodiment obtaining a cooled split stream 112' is done by passing the split stream 112 through an expander 113 or valve to obtain the cooled split stream 112'.

Using an expander 113, although being a more complex and expensive piece of hardware than a valve, is preferred as it creates a colder flow than a valve and therefore allows for a minimal flow rate of the split stream 112.

The cooled split stream 112' may typically be cooled to below −60° C., for instance to below −80° C.

According to an example, the split stream 112 is let down in pressure from 52 bara to 8 bara over a turbo-expander 113 and is thereby cooled from −28° C. (stream 112) to −80° C. (stream 112'). If instead a JT valve would be used, the same pressure reduction would result in a cooling from −28° C. (stream 112) to −60° C. (stream 112').

Typically, the temperature of the cooled split stream 112' is in the range −60° C. to −120° C. and has a pressure in the range of 8-10 bara. The internal condenser 206 is fed with a condenser feed stream 204. According to the embodiments described, the condenser feed stream 204 comprises the cooled split stream 112'. Thereby, cooling duty is provided to the internal condenser 206 and thus to the top of the fractionation column 201 in an efficient manner.

According to an embodiment the method further comprises (f) feeding a feed stream 231 to a second cooling stage, the feed stream 231 comprising the main overhead stream 111, to obtain a cooled liquefied hydrocarbon stream 225.

FIG. 1 schematically shows the second cooling stage, schematically being represented by a single heat exchanger 115, although it will be understood that any type and number of parallel and/or serial heat exchangers may be used. The heat exchanger 115 of the second cooling stage is arranged to receive a second refrigerant stream 114 and discharge a warmed second refrigerant stream 114*a*. The refrigerant cycle of the second refrigerant, typically comprising a compressor, condenser and expansion valve or the like, is not shown. The second refrigeration cycle may include cooling the second refrigerant by the first refrigerant.

The second cooling stage may comprise a main cryogenic heat exchanger through which the second refrigerant is cycled, wherein the second refrigerant is split in a light mixed refrigerant and a heavy mixed refrigerant.

The first and second cooling stage may be refrigerated by first and second refrigeration cycles with first and second refrigerants (100/114) respectively, wherein the first refrigerant is heavier than the second refrigerant. The first and second refrigerants may be single component refrigerants and/or mixed refrigerants. The presence of additional cooling stages is of course not excluded.

According to an embodiment, splitting the methane enriched vapour overhead stream 110 in a main overhead stream 111 and a split stream 112 is done upstream of the second cooling stage.

According to an embodiment the method further comprises (g) obtaining a condenser outlet stream 205 from the condenser 206 and combining the condenser outlet stream 205 and the top stream enriched in C1-C2 220 providing a combined stream 222, (h) feeding a further feed stream 223 to a second cooling stage, the further feed stream 223 comprising the combined stream 222, to obtain a further cooled liquefied hydrocarbon stream 224.

The pressure of the split stream 112 is preferably reduced when expansion-cooling the split stream to a pressure substantially equal to the pressure of the top stream 220 of the fractionation column 200. The term substantially is used here to indicate that the two streams can be combined without the need of further pressure reduction or pressure increasing devices like valves or pumps.

Combining the condenser outlet stream 205 and the top stream enriched in C1-C2 220 providing a combined stream 222 can be done with any suitable combiner 221, such as a T-piece.

According to an embodiment the main overhead stream 111 and the combined stream 222 are cooled in parallel cooling paths in the second cooling stage.

The main initial overhead stream and the combined stream are cooled in parallel in the second cooling stage, preferably in the same one or more heat exchangers, usually referred to as the main cryogenic heat exchanger(s).

The main initial overhead stream 111 and the combined stream 222 are passed through the second cooling stage at a different pressure. The main overhead stream 111 is passed through the second cooling stage at a first pressure and the combined stream 222 is passed through the second cooling stage at a second pressure, the first pressure being greater than the second pressure. As the initial overhead stream 111 is typically at a higher pressure than the combined stream 222 and cooling can be done most effectively at higher pressures, the streams are not combined prior to the second cooling stage, but are passed through the same heat exchanger(s) 115 of the second cooling stage via different cooling paths, e.g. cooling tubes, running in parallel.

According to an alternative embodiment, the main overhead stream 111 and the combined stream 222 are combined upstream of the second cooling stage. Before combining, the combined stream 222 may be compressed and/or the main overhead stream 111 may be reduced in pressure to match the pressure of the main overhead stream 111 and combined stream 222 prior to combining. Compressing the combined stream 222 may be done with a compressor which can be partially driven by the expander 113. The compressor and the expander 113 may for instance have combined axis.

According to an embodiment the method comprises (h) combining the cooled liquefied hydrocarbon stream 225 and the further cooled liquefied hydrocarbon stream 224 downstream of the second cooling stage.

Combining may comprise equalizing the pressures of both the cooled liquefied hydrocarbon stream 225 and the further cooled liquefied hydrocarbon stream 224 by passing both streams through a respective valve or expander 301. The cooled liquefied hydrocarbon stream 225 is preferably passed through an expander 301 and the further cooled liquefied hydrocarbon stream 224 is preferably passed through a Joule-Thompson valve 301.

Typically, the cooled liquefied hydrocarbon stream 225 and the further cooled liquefied hydrocarbon stream 224 are let down to 3 bar above the bubble point of the streams (e.g. 4-5 bara).

The combined stream 303 is then fed to a LNG storage tank 302 or via an end-flash vessel to a LNG storage tank (not shown).

According to an embodiment (d) comprises controlling a mass flow of the split stream 112 in response to one or more of the following parameters, but not limited to: a temperature indication (T) of the top stream enriched in C1-C2, a temperature indication of the cooled split stream 112', composition of the top stream enriched in C1-C2.

The mass flow of the split stream 112 may be controlled in any suitable manner, such as by controlling the settings of two outlet valves (not shown) on the T-piece 130 or one valve (not shown) downstream junction 130 in conduit 112.

The temperature indication may be a measured temperature of the top stream enriched in C1-C2 obtained by a direct temperature measurement or a temperature indication obtained from a temperature measurement at a top tray of the fractionation column 200 or a tray at the top part 201 of the fractionation column 200.

A temperature controller 131 is provided which controls the mass flow of the split stream 112 based on a received temperature indication (T). According to the example shown in FIGS. 1 and 2, the temperature indication (T) is obtained from the top stream enriched in C1-C2.

The midstream 230 enriched in C3 and C4 may be passed to a storage tank (not shown) to be sold separately or to be used as refrigerant make-up.

According to an embodiment the feed stream 231 to the second cooling stage further comprises the midstream enriched in C3-C4 230.

The method according to this embodiment thus comprises combining the midstream enriched in C3-C4 and the main overhead stream 111 obtaining a combined stream, wherein the feed stream to the second cooling stage comprises the combined stream. Combining may be done by any suitable combiner 150, such as a T-piece.

FIG. 3 schematically depicts an alternative embodiment, in which splitting the methane enriched vapour overhead stream 110 in a main overhead stream 111 and a split stream 112 is not done upstream of the second cooling stage, as depicted in FIGS. 1 and 2, but at an intermediate position in the second cooling stage, in particular at an intermediate position of the heat exchanger 115.

The heat exchanger 115 may be a cryogenic main heat exchanger through which light and heavy mixed refrigerant are cycled through parallel (set of) tubes carrying the light and heavy mixed refrigerant respectively. The heat exchanger 115 also comprises a plurality of tubes carrying the stream(s) to be cooled by the light and heavy mixed refrigerants.

The intermediate position may be chosen at a position where the tubes exit the heat exchanger to allow the heavy mixed refrigerant to expand and be reintroduced to the shell side of the heat exchanger 115 to provide cooling. The tubes carrying the light mixed refrigerant re-enter the heat exchanger and exit the heat exchanger at a downstream position (downstream with respect to the intermediate position) to be expanded and reintroduced to the shell side of the heat exchanger 115 to provide cooling.

According to such an embodiment splitting the methane enriched vapour overhead stream 110 in a main overhead stream 111 and a split stream 112 is done at an intermediate position in the second cooling stage.

The second cooling stage, in particular the heat exchanger (s) 115 comprised by the second cooling stage, comprises a second cooling stage inlet 233 for receiving the methane enriched vapour overhead stream 110 and a second cooling stage outlet 232 for discharging the cooled liquefied hydrocarbon stream 225, the intermediate position being at a position in between the second cooling stage inlet and outlet 233, 232.

In FIG. 3, the second cooling stage is shown as a single heat exchanger in which a single refrigerant cooling path 114, 114' is shown.

The split stream 112 is passed to a valve or expander 113 to obtain a cooled split stream 112' and fed as the condenser feed stream 204 to the internal condenser 206.

EXAMPLE

Next, the functioning of the embodiment as shown in FIG. 2 will be described by way of example.

A hydrocarbon feed stream 7 is passed through the first cooling and separation stage to produce a methane depleted liquid stream 10 of 6.1 kg/s, at a temperature of −24.6° C. and a pressure of 8.5 bara, comprising 30 mol % methane, 13 mol % ethane, 16 mol % propane, 24 mol % butane and 17 mol % C5+. The mass flow of methane depleted liquid stream 10 is 6.1 kg/s.

A split stream 112 of 5.2 kg/s is obtained at a temperature of −27.6° C. and a pressure of 51.3 bara, comprising 1 mol % N2, 88 mol % methane, 8 mol % ethane and 3 mol % propane. After having passed expander 113, a cooled split stream 112' is obtained having a temperature of −87.4 C and a pressure of 8.3 bara.

From fractionation column 200, the following streams are obtained:

- bottom condensate stream 210 of 1.9 kg/s, having a temperature of 124.1° C., a pressure 8.7 bara and comprising approximately 100 mol % C5+;
- a top stream enriched in C1-C2 220 of 3.2 kg/s, having a temperature of 11.9° C. and a pressure of 8 bar, comprising 42 mol % methane, 18 mol % ethane, 21 mol % propane and 19 mol % butane;
- midstream enriched in C3-C4 230 of 1 kg/s, having a temperature of 37.3° C. at a pressure of 8.4 bara comprising 4 mol % methane and ethane, 12 mol % propane, 81 mol % butane and 3 mol % of C5+.

The person skilled in the art will understand that the present invention can be carried out in many various ways without departing from the scope of the appended claims.

That which is claimed is:

1. A method of cooling and separating a hydrocarbon stream, the method comprising at least the steps of:

(a) passing a hydrocarbon feed stream through a first cooling and separation stage to provide a methane enriched vapor overhead stream and a methane depleted liquid stream;

(b) passing the methane depleted liquid stream to a fractionation column to separate the methane depleted liquid stream in a bottom condensate stream, a top stream enriched in C1-C2 and a midstream enriched in C3-C4, (c) cooling the upper part of the fractionation column by a condenser, (d) splitting the methane enriched vapor overhead stream in a main overhead stream and a split stream and obtaining a cooled split stream by expansion-cooling the split stream, (e) feeding a condenser feed stream to the condenser, the condenser feed stream comprising the cooled split stream, to provide cooling duty to the top of the fractionation column, (g) obtaining a condenser outlet stream from the condenser and combining the condenser outlet stream and the top stream enriched in C1-C2 providing a combined stream, and (h) feeding a first feed stream to a second cooling stage, the first feed stream comprising the combined stream, to obtain a further cooled liquefied hydrocarbon stream.

2. Method according to claim 1, wherein obtaining a cooled split stream is done by passing the split stream through an expander or valve to obtain the cooled split stream.

3. Method according to claim 1, wherein the method comprises (f) feeding a second feed stream to the second cooling stage, the second feed stream comprising the main overhead stream to obtain a cooled liquefied hydrocarbon stream.

4. Method according to claim 3, wherein splitting the methane enriched vapor overhead stream in a main overhead stream and a split stream is done upstream of the second cooling stage.

5. Method according to claim 1, the method comprising:

(f) feeding a second feed stream to the second cooling stage, the second feed stream comprising the methane enriched vapor overhead stream;

wherein splitting the methane enriched vapor overhead stream is done at an intermediate position in the second cooling stage.

6. Method according to claim 1, wherein the main overhead stream and the combined stream are cooled in parallel cooling paths in the second cooling stage.

7. Method according to claim 3 wherein the method comprises (i) combining the cooled liquefied hydrocarbon stream and the further cooled liquefied hydrocarbon stream downstream of the second cooling stage.

8. Method according to claim 1, wherein step (d) comprises controlling a mass flow of the split stream in response to one or more of the following parameters: a temperature indication (T) of the top stream enriched in C1-C2, a temperature indication of the cooled split stream, composition of the top stream enriched in C1-C2.

9. Method according to claim 3, wherein the feed stream to the second cooling stage further comprises the midstream enriched in C3-C4.

10. Method according to claim 1, wherein step (a) comprises (a1) passing the hydrocarbon feed stream through a pre-cooler obtaining a pre-cooled, partially condensed hydrocarbon feed stream, (a2) passing the pre-cooled, partially condensed hydrocarbon feed stream to a first separator to provide at least the methane depleted liquid stream.

11. Method according to claim 10, wherein step (a) further comprises (a3) obtaining a pre-cooled vapor hydrocarbon stream as top stream from the first separator and passing the pre-cooled vapor hydrocarbon stream to a further pre-cooler obtaining a further pre-cooled hydrocarbon feed stream, (a4) passing the further pre-cooled hydrocarbon feed stream to a second separator to provide at least the methane enriched vapor overhead stream.

12. A system for cooling and separating a hydrocarbon stream comprising:

a first cooling and separation stage for receiving a hydrocarbon feed stream and generate a methane enriched vapor overhead stream and a methane depleted liquid stream;

a fractionation column comprising an inlet arranged to receive the methane depleted liquid stream, a bottom outlet for discharging a bottom condensate stream, a top outlet for discharging a top stream enriched in C1-C2, and a mid-outlet for discharging a midstream enriched in C3-C4, an expansion-cooling device arranged to receive the split stream from the methane enriched vapor overhead stream and generate a cooled split stream by expansion-cooling the split stream, a condenser being positioned in the upper part of the fractionation column to provide cooling duty to the fractionation column, the condenser comprising an inlet for receiving a condenser feed stream, wherein the condenser feed stream comprises the cooled split stream, and an outlet for providing a condenser outlet stream from the condenser;

the system being arranged to combine the condenser outlet stream and the top stream enriched in C1-C2 to provide a combined stream, and to feed a first feed stream to a second cooling stage, the first feed stream comprising the combined stream, to obtain a further cooled liquefied hydrocarbon stream.

13. A liquefied natural gas plant or facility including a system according to claim 12.

* * * * *